United States Patent [19]

Krauss

[11] 4,019,416

[45] Apr. 26, 1977

[54] HYDRAULIC PAPER CUTTER

[75] Inventor: Edward W. Krauss, Skokie, Ill.

[73] Assignee: IPEC, Inc., Chicago, Ill.

[22] Filed: Apr. 28, 1975

[21] Appl. No.: 572,262

[52] U.S. Cl. ..... 83/437; 83/207; 83/465; 83/588; 83/639; 83/646; 83/278

[51] Int. Cl.[2] ..... B26D 5/04; B26D 7/02

[58] Field of Search ..... 83/207, 278, 644, 437, 83/643, 642, 379, 636, 639, 646, 588, 465; 214/1.6

[56] References Cited

UNITED STATES PATENTS

| | | | |
|---|---|---|---|
| 1,884,912 | 10/1932 | Stukart | 83/207 |
| 2,531,219 | 11/1950 | Johnston | 83/643 X |
| 2,649,153 | 8/1953 | Barley | 83/644 X |
| 2,649,912 | 8/1953 | Frankel | 214/1.6 |
| 3,173,327 | 3/1965 | Rupp | 83/643 X |
| 3,182,542 | 5/1965 | Cochran | 83/644 X |
| 3,187,614 | 6/1965 | Pollard | 83/207 |
| 3,393,592 | 7/1968 | De Maredsous | 83/207 |

*Primary Examiner*—Frank T. Yost
*Attorney, Agent, or Firm*—Laff, Whitesel & Rockman

[57] ABSTRACT

A paper knife is mounted at its opposite ends on a pair of arcuate arms pivotally attached to the knife table. The knife is operated by a fluid cylinder which extends from the table to the knife. This way all of the operating apparatus is positioned beneath and not above the table, thereby providing a low profile so that the operator may reach over the knife. Various mechanical details enable quick paper sets and closer cuts.

11 Claims, 15 Drawing Figures

HYDRAULIC PAPER CUTTER

This invention relates to paper cutters and more particularly to low profile hydraulic paper cutters having new and improved cutting features.

Paper cutters are well known devices which come in many sizes. The larger paper knives are massive structures set on cast iron bases with guillotine blades suspended above a table high base plate. In order to apply enough pressure to cut through a tall stack of paper, it has been common practice to have a massive super structure raising substantial heights above the table level. This super structure includes massive pressure applying means (such as a hydraulic ram) for lowering the guillotine blade.

This prior art structure is very costly because of the massiveness of the structure. The cast iron base is also an expensive and awkward device. The super structure blocks the operators view, is unsightly, and awkward to work around. Many of these disadvantages would disappear if the cutter could be made from sheet steel instead of cast iron.

Another problem is that the massiveness of these prior art cutters is such that it is impossible to make many cuts (such as a cut close to the margin) which are desirable. For example, a back gauge on the table may be positioned to push, align, and square a stack of paper in desired cutting position. A hold down clamp, which then secures the stack of paper to the table, may emboss the paper so that it is permanently deformed. However, since the paper knife is on the opposite side of the hold down clamp, with respect to the back gauge, it is not easily possible to cut off the deformed embossment. If the paper is turned around by 180°, so that the hold down clamp rests upon the edge of the paper which is cut off, the hold down clamp prevents the back guage from approaching closer than, say a half-inch, towards the blade. Thus an unduly wide margin is cut off.

An example of when this lack of capability makes a difference is found in damage to a book. If the edges of the pages are soiled or water-marked, the book may be restored to a new appearance by trimming off an eighth of an inch from each edge. However, if the entire book is placed under the hold down clamp and pushed toward the blade, the clamp deforms the pages. If the book is turned around and the edge to be cut off is placed under the hold down clamp, a minimum half-inch of the page margin will be cut off. The only alternative is to give up the use of the back gauge and to position the book by eye or by a homemade spacer inserted between the hold down clamp and the back gauge. It is almost impossible to obtain a satisfactory square cut under these circumstances.

Aside from these practical problems, the massive super-structure makes it difficult to see and align the back of the paper, to reach around and manually control the back gauge, or the like. Accordingly, an object of the invention is to provide new and improved paper knives. Here an object is to provide paper knives which are simple in construction and easy to use. In particular, an object is to provide a paper knife which does not have the super-structure used heretofore. In this connection, an object is to provide a paper knife, having a table, all parts of which may be reached by the operator from the normal operating position.

Another object of the invention is to provide a paper knife having a base made of sheet steel. Here an object is to eliminate expensive construction, such as cast iron. More particularly, an object is to reduce the cost without reducing the performance characteristics. For example, an object is to bring the back gauge up to within one thousandth of an inch of the knife.

In keeping with an aspect of this invention, these and other objects are obtained by providing a table high paper knife having a sheet metal base. A guillotine knife is suspended over the table, but operated by hydraulic rams extending toward the table. Thus, it is simple to reach over the knife and table to make any adjustments. For example, it is possible to release the back gauge and to slide it quickly and easily to any position, thereby reducing the time heretofore required for back gauge adjustments. The back gauge and hold down clamp are comb-like structures which come together with intermeshed teeth so that they do not interfere with or limit each other.

The nature of a preferred embodiment for accomplishing these ends may be understood best from a study of the following specification in connection with the attached drawings, wherein.

Figure 4A:
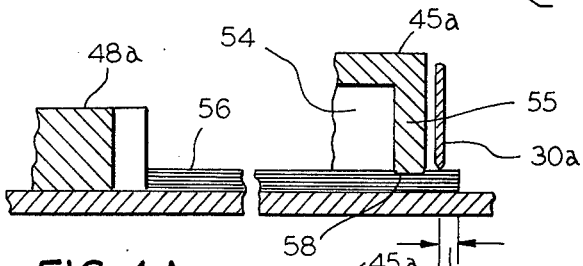
FIG. 4A (PRIOR ART)
Figure 5:
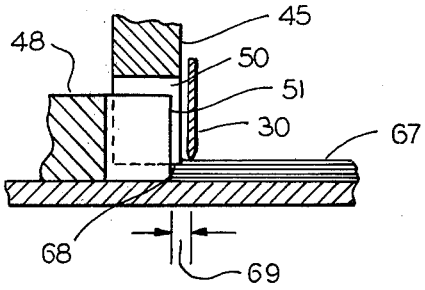
Figure 4B:
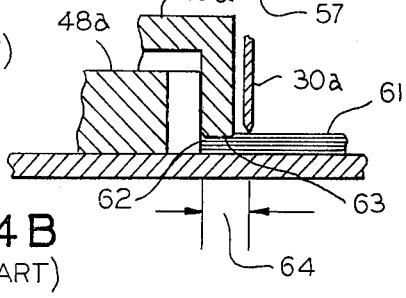
FIG. 4 B (PRIOR ART)
Figure 6:
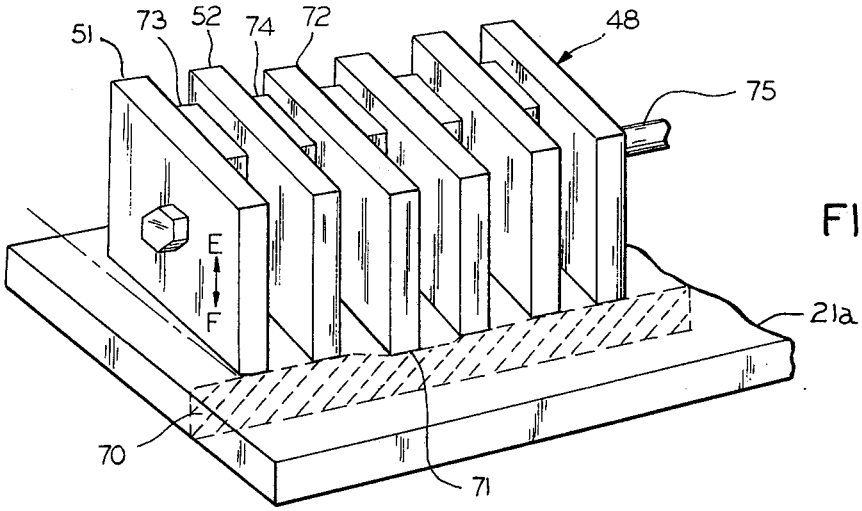
Figure 7A:
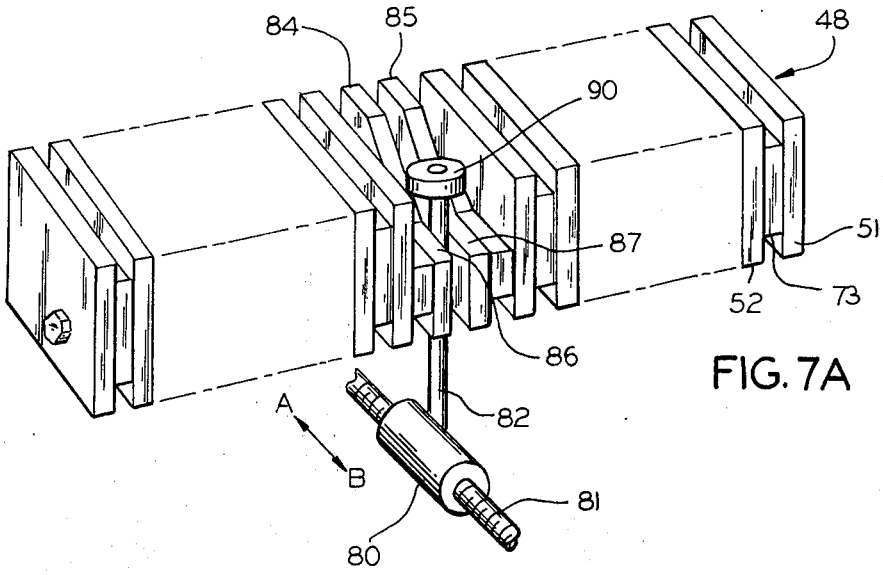
Figure 7B:
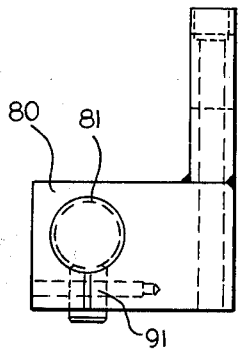
Figure 7C:
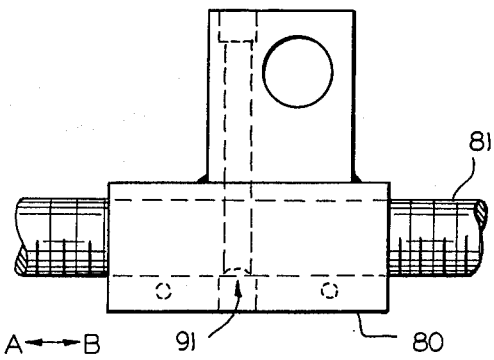
Figure 8:
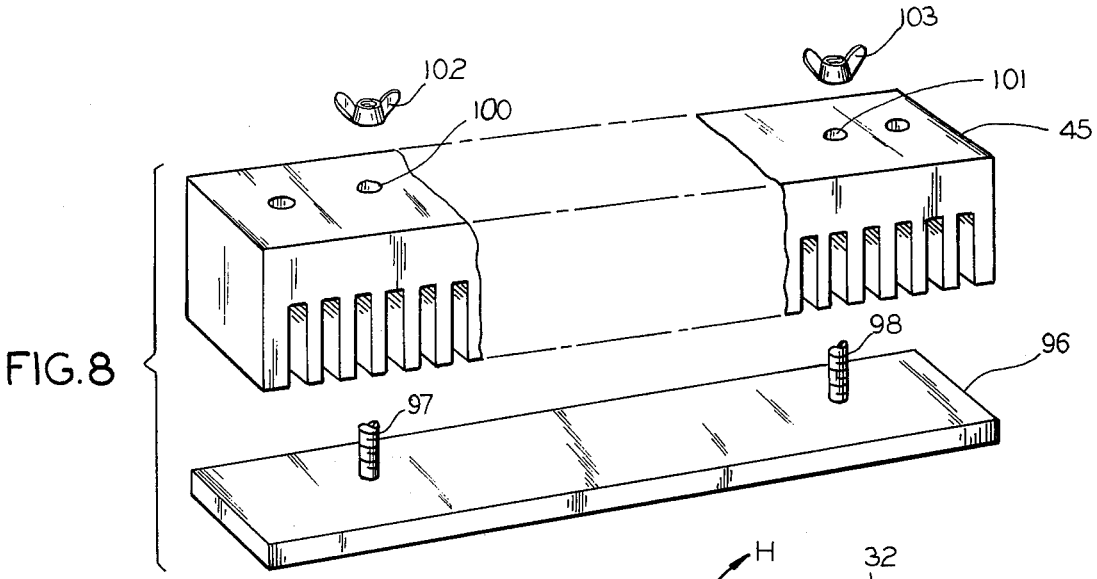
Figure 9A:
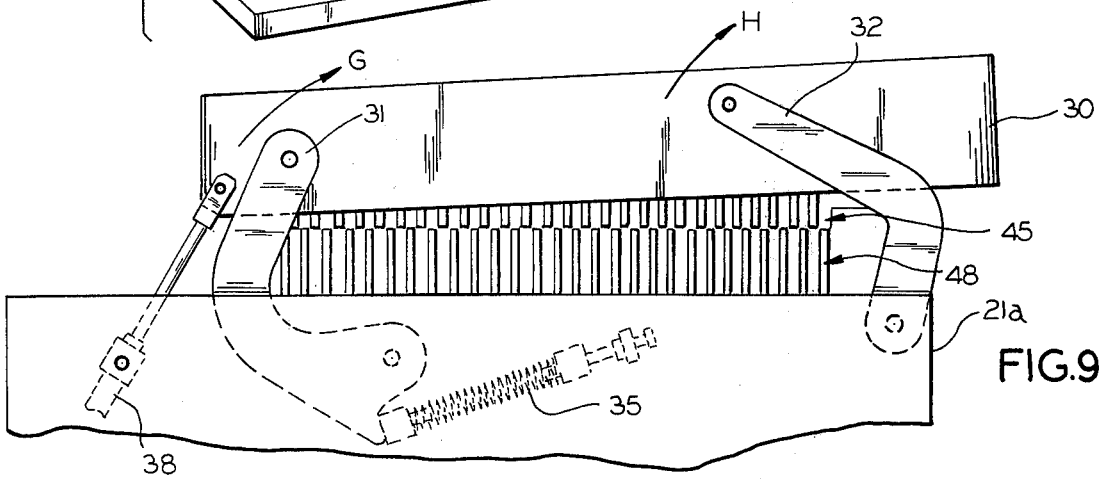
Figure 9B:
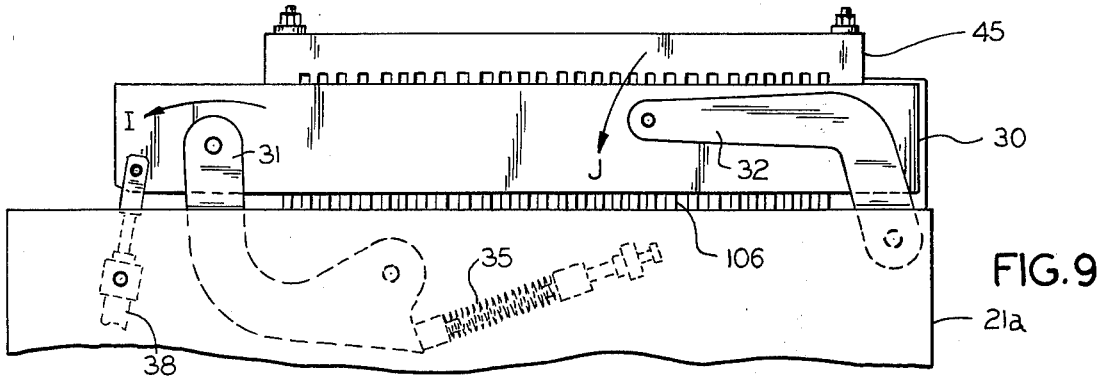
Figure 9C:
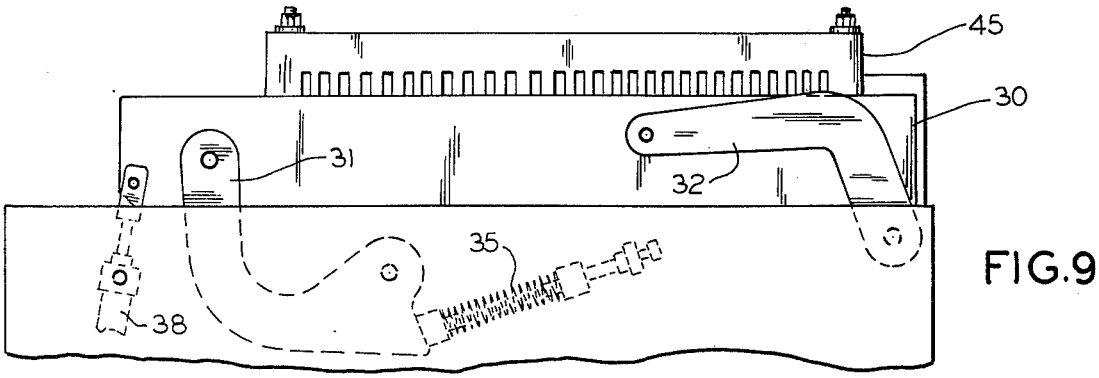

FIGS. 4A and 4B schematically illustrate how the prior art structure limits the cutting capability;

FIG. 5 schematically illustrates how the inventive structure overcomes the problems illustrated in FIGS. 4A and 4B;

FIG. 6 schematically illustrates how the back gauge is constructed to accommodate minor irregularities in the surface of the table;

FIG. 7A schematically illustrates how the comb-like back gauge may be released for movement quickly to a preselected position;

FIGS. 7B and 7C are, respectively, schematic end and side views of a back gauge feed screw and clamp for releasably securing the back gauge thereto;

FIG. 8 is a perspective view of a face plate for a hold down clamp to effectively eliminate the toothed structure when it becomes necessary or desirable to do so; and FIGS. 9A–9C are three stop motion views showing the operation of the guillotine knife action.

Figure 1:
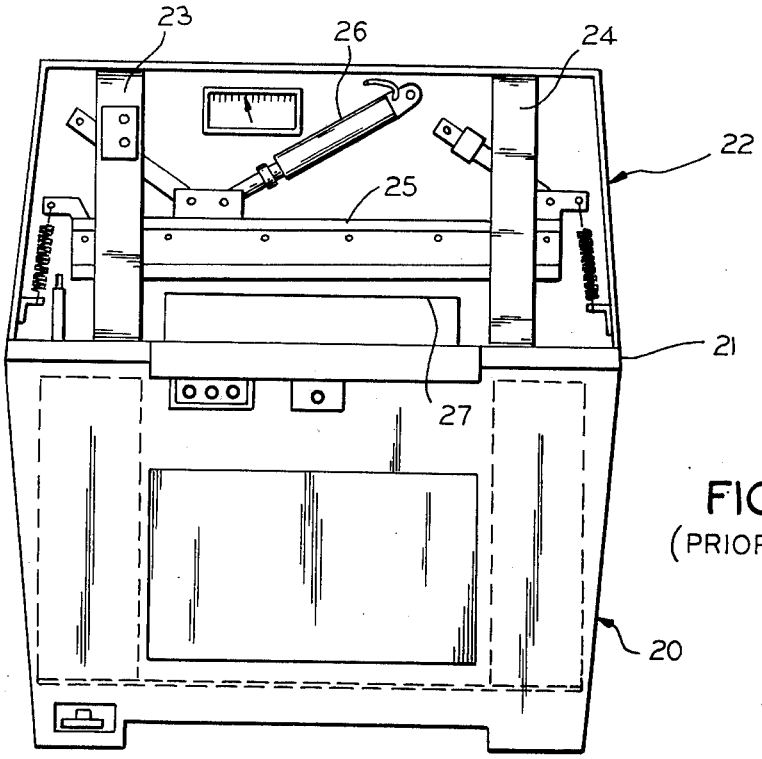
FIG.1 (PRIOR ART)
FIG. 1 is a front elevation view of a prior art paper knife.

The prior art paper knife of FIG. 1 may have any known form and structure. For example, it could be the device shown in U.S. Pat. No. 3,754,492, of Edward William Krauss, and assigned to the assignee of this invention. Since the details of this device are explained in U.S. Pat. No. 3,754,492, no attempt will be made to repeat them herein.

Basically, this paper knife comprises a base 20, table 21, and super structure 22. The super structure 22 contains a pair of upright standards 23, 24 for stabilizing a guillotine knife 25. When a hydraulic ram 26 is operated the knife 25 is raised or lowered to enable insertion or to cut the paper.

The result is a relatively tall structure which blocks the view and prevents easy operation. For example, a back gauge 27 pushes paper into the path of the knife 25. However, it would not be convenient to reach over, around, or through the super structure 22 to manually control the back gauge. It might be disastrous to reach under the knife 25. Therefore, the only practical solution is to walk around and work on the back gauge from a point behind the paper knife. This is not practical. Accordingly, a chief object of the invention is to eliminate or reduce most of the superstructure 22. If this structure is physically made lower, it becomes easy to work on almost any part of the paper knife from the operator position.

Figure 2A:
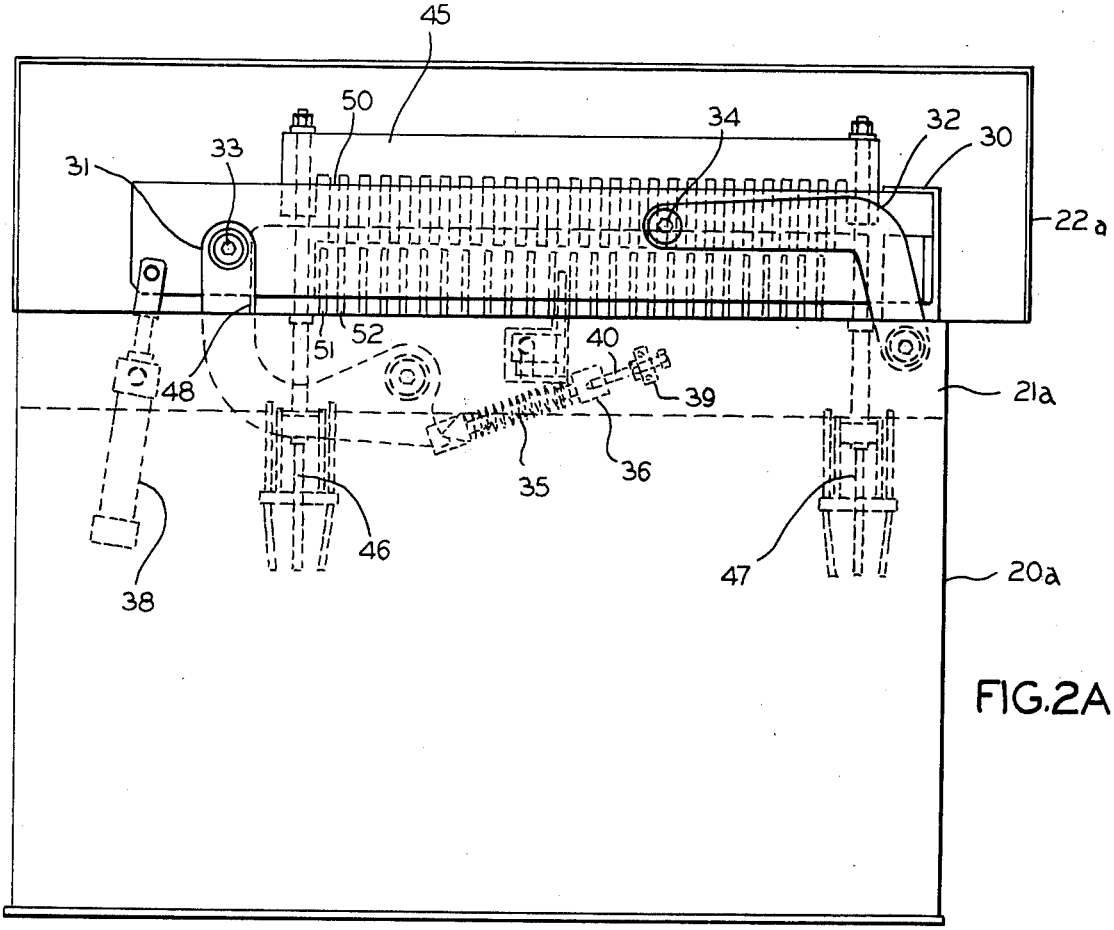
FIG. 2A is a front elevation view of a paper knife constructed according to the teachings of the invention.

According to the invention, the paper knife FIG. 2A includes a base 20*a*, table 21*a*, and sheet metal housing 22*a* which protects people who may work around the cutter blade. The base 20*a* is made from sheet steel which may be cut, folded, embossed, and otherwise fabricated without resort to expensive iron castings. This means that the structure is lighter and less massive. The table 21*a* is preferably a massive sheet of steel which has been machined to have a smooth surface. The sheet metal housing 22*a* has been reduced to the height required for a raised knife blade.

In greater detail, the inventive structure comprises a knife blade 30 mounted on two L-shaped swing arms 31, 32. One end of each arm is pivotally connected to the knife at longitudinally displaced points 33, 34. The other end of each arm is pivotally connected to the table top 21*a*. Hence, by swinging on the arms 31, 32 the knife 30 may be raised or lowered with a slicing action. A compression spring 35 is positioned to rest between a bracket 36 attached to table 21*a* and the swinging arm 31 to urge knife 30 to a raised position. A hydraulic cylinder 38 is connected between the knife 30 and the base 20*a* to pull down and lower the knife 30 against the urging of spring 35. A nut 39 may be rotated on a threaded shaft 40 to adjust the bias of the spring 35 acting upon arm 31 to raise the knife 30.

Behind the knife 30 is a hold down clamp 45 having a somewhat comb shape. The clamp may be moved up or down under the urging of hydraulic cylinder clamps 46, 47. When the hydraulic cylinders are actuated, the hold down clamp 45 is lowered until it firmly clamps to the table any paper which may be under the blade.

Further back, behind the hold down clamp 45, is the back gauge which may be moved toward or away from the blade thereby pushing the paper toward or allowing it to be moved away from the blade.

It should be noted that, according to the invention, both the hold down clamp 45 and the back gauge 48 are toothed, comblike structures. The teeth (such as 50) of the hold down clamp 45 are interspersed between the teeth (such as 51, 52) of the back gauge 48. Therefore, the teeth of the back gauge may be advanced through the teeth of the hold down clamp 45. Accordingly, the back gauge may be advanced to within a short clearance space behind the blade (such as one-thousandths of an inch), without the necessity of allowing substantial room between the back gauge and the blade, for the hold down clamp 45.

Figure 2B:
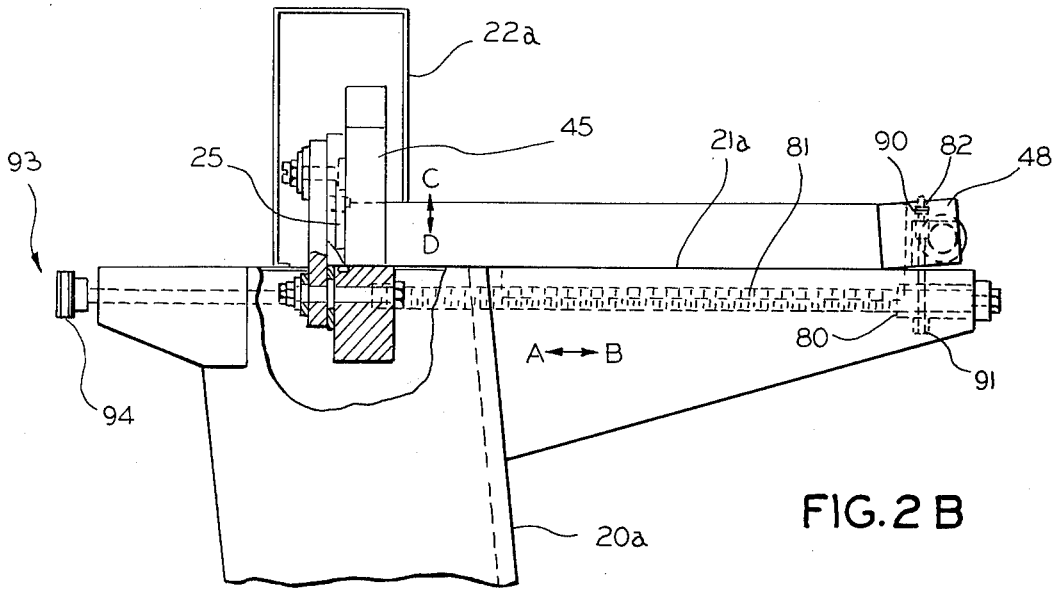
FIG. 2B is a side elevation view of the same paper knife.
Figure 3:
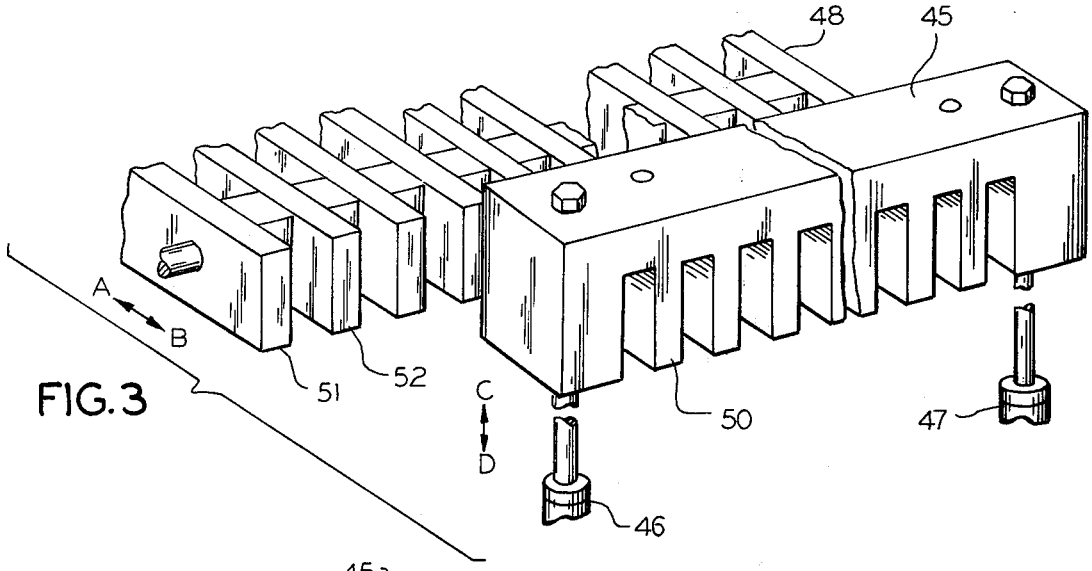
FIG. 3 is a perspective view of a comb-like hold clamp and a back gauge, wherein the teeth intermesh so that they do not interfere with or limit each other.

This aspect of the invention is seen in FIGS. 2B, 3 and explained in FIGS. 4, 5. As there shown, the back gauge 48 moves back and forth in directions A, B and the back gauge moves up and down in directions C, D. Heretofore, the prior art hold down clamp 45*a* (FIG. 4A) was made thinner by milling out recesses 54 for the back gauge 48*a* to enter. Nevertheless, a thickness 55 has always remained between the back gauge 48*a* and blade 30*a*. Therefore, when paper 56 is placed between the back gauge 48*a* and blade 30*a*, it has been possible to trim off a small end portion 57. However, the hold down clamp at 55 has tended to emboss and permanently deform the paper at 58. If the top pages are important, this embossment is not acceptable. If the top pages are protective dummys, there is a wasteful usage of paper.

It is possible to turn the paper around (as at 61, FIG. 4B) and to put the end 62 under the hold down clamp 45*a*. The blade 30*a* will cut off the embossed and deformed paper at 63. However, the back gauge 48*a* cannot push the paper 61 any closer to blade 30*a* than a wide space 64. It is not always possible to trim this much of the margin from the paper 61.

According to the invention (FIG. 5), the teeth of the back gauge 48 interleave with the teeth of the hold down clamp 45 and push the paper 67 very close to the blade 30. The hold down clamp 45 may bear down upon, emboss, and deform the ends 68 of the paper 67. However, the amount of trimmed margin 69 is comparable to the best which the prior art device could do (shown at 57, FIG. 4A) with the deforming embossment. The inventive paper knife 30 trims off the deformed embossement at 68. FIGS. 4, 5 have been drawn to show and illustrate the problems. The minimum distance 69 is in the order of one thousandths of an inch for the inventive device, which is the minimum practical cut for any mechanical device, such as this.

Means are provided for accommodating minor surface irregularities on the top of a paper knife table. In greater detail, the table 21*a* is preferably a massive sheet of steel, such as 4 inches thick, which has been machined to have a flat surface. Ideally, the surface is an absolutely and perfectly planar surface. Therefore, there should be no problems. However, such perfection does not exist in any real sense. Therefore, FIG. 6 has been drawn with a phantom cross section 70 to illustrate how the table surface may have a minor depression at 71. If the toothed back gauge 50 is rigid, the tooth 72 would have a space beneath it, which might allow a sheet of paper to pass under it. Then, one or more sheets might be cut in an imperfect manner.

According to the invention, this problem is overcome since the back gauge is a completely flexible assembly of tooth plates and spacers. More particularly, with two exceptions, each tooth plate (such as 51, 52) is a rectangular plate having a hole drilled near one side. Each spacer (such as 73, 74) is a much smaller plate, also having a hole drilled therein. A threaded shaft 75 fits through each of the holes, with teeth and spacers interleaved. Thus, tooth plate 72, for example, is completely free to move up or down in direction E, F. The weight of the tooth plate is in front of the shaft 75 since the holes for shaft 75 are drilled nearer to the back edge. Accordingly, the front edges of each tooth plate rests on the surface of the table 21*a*. Therefore, even when there is a depression (or a mound), as at 71, the opposing tooth 72 rests on the table, and no paper can slip under it. The spacers 73, 74 provide the clearance for passage of the hold down clamp teeth.

Means are provided for quickly positioning the back gauge responsive to a manual movement and thereafter for adjusting the selected position by a fine adjustment for a feed screw. More specifically, for normal fine position adjustment, the back gauge 48 is mounted on a sleeve bearing 80 which slides over a feed screw. A rod 82 passes down through the teeth of the back gauge 48. The two adjacent tooth plates 84, 85 have cut out portions 86, 87 which provide clearance for depression of the rod 82.

On the top of rod 82 is a nut 90 which may be turned to travel downwardly to lock together the back gauge 48, rod 82, sleeve 80 and feed screw 81. When the nut 90 is turned to travel upwardly, it forms a thumb pad which may be pushed.

For coarse back gauge positioning, the bottom of rod 82 includes a mechanism 91 which is in the form of a tooth which mates with the travels in the threads on the rod 81. When the rod 82 is locked in a raised position, the tooth 91 engages the thread so that sleeve 80 travels back and forth for fine position adjustments in the directions A, B. When the rod 82 is lowered, the tooth disengages the rod so that the sleeve 80 may slide freely back and forth for quick set, coarse position adjustments in directions A, B.

It should now be clear that a worker standing in front of the paper knife (e.g., at 93, FIG. 2B) may easily reach over the sheet metal housing 22*a*, loosen nut 90, push down rod 82, and slide the back gauge to any desired position. Then, the rod 82 may be released, whereupon a bias spring (not shown) raises tooth 91 into engagement with the threaded rod 81.

A knob 94 may then be turned to rotate feed screw 81 and thereby bring the back gauge to a precisely desired location.

Means are provided for giving the hold down clamp a smooth and unbroken surface. Sometimes there are problems when the toothed ends of the hold down clamp 45 must be lowered onto easily deformed surfaces. For this reason, a plate 96 is shaped and dimensioned to fit over and completely cover the bottom tips of the teeth on the hold down clamp 45. Integral with and upstanding on the plate 96 are two bolts 97, 98 which fit through holes 100, 101 formed in the hold down clamp. Winged nuts 102, 103 may be turned onto the bolts 97, 98 to secure plate 96 in place. The plate 96 is thick enough and smooth enough to elminate all evidences of contact between the tips of the teeth and the paper.

The operation of the inventive paper knife 30 is shown by the three stop motion views of FIG. 9. In FIG. 9A, the hold clamp 45 is in its raised position. The back gauge 48 is moved back in direction B (FIG. 2B). Hydraulic cylinder 38 is in an extended position. The compression spring 35 is shown pushing against the arm 31 to swing it in direction G and to raise the left end of the knife 30. In so moving, the knife forces arm 32 to swing in direction H, thereby raising the knife.

After the paper is slipped under the blade and against the back gauge 48, the back gauge is moved forward until the paper is properly positioned relative to the knife. The hold down clamp 45 is lowered.

Thereafter, the fluid cylinder 38 is actuated (FIG. 9C) to pull the left hand end of the knife 30 in the direction I.

As the end is so pulled down, the arm 32 swings in direction J, thereby lowering the knife edge onto a stack of paper 106. As the fluid cylinder 38 continues to be actuated, the knife 30 is pulled down firmly against the table. The arm 32 follows to lower the right hand end of the knife and thereby complete the cut.

When the fluid cylinder 38 is released, the spring 35 pushes the arm 31 back into the knife elevated position, as shown in FIG. 9A.

Those who are skilled in the art will readily perceive modifications which may be made without departure from the scope and the spirit of the invention. Therefore, the appended claims are to be construed to cover all equivalent structures.

I claim:

1. A low profile hydraulic paper cutter comprising a supporting table having a hold-down clamp means, a back gauge, a paper knife, and a protective housing around the knife above the top of said table and means for controlling said hold down clamp means, back gauge and knife positioned below the top of said table, means for pivotally mounting said paper knife adjacent its opposite ends on a pair of arcuate arms pivotally attached to said supporting table below the table top, means also located below the table top for selectively operating said paper knife blade to swing it on said arcuate arms with a slicing action, said operating means extending from below the supporting table to the knife blade, whereby the blade operating apparatus is positioned beneath and not above the table, means under said table top for enabling quick sets of the back gauge to position said paper under the knife blade, and means for operating said quick set means from a point above the table top.

2. The cutter of claim 1 wherein said back gauge is a toothed structure, said means for enabling quick paper sets comprises disengageable means for moving said toothed back gauge structure in either of opposed reciprocal motions, toward and away from said paper knife blade, said disengageable means being normally engaged for fine adjustment of back gauge position and releasable for coarse adjustment.

3. The cutter of claim 2 wherein said hold down clamp means is interposed between said back gauge and said blade, said clamp means comprising a toothed structure mounted so that the teeth of said back gauge and said hold down clamp intermesh, whereby the teeth of said back gauge may be moved up to said knife blade.

4. A hydraulic paper cutter comprising a paper knife pivotally mounted adjacent its opposite ends on a pair of arcuate arms pivotally attached to a supporting table, each of said arcuate arms being an L-shaped structure pivotally connected at one end to said knife blade and pivotally connected at the other end to the supporting table, means for selectively operating said paper knife blade to swing it on said arcuate arms with a slicing action, said operating means extending from the supporting table to the knife blade, whereby the blade operating apparatus is positioned beneath and not above the table, means for enabling quick sets of the paper under the knife blade, and bias means interposed between said table and said L-shaped arm for urging said knife blade to an open position.

5. The cutter of claim 4 wherein said operating means comprises a fluid cylinder connected between said knife blade and said supporting table for pulling said knife against the bias of said bias means for lowering said knife with said slicing action.

6. A hydraulic paper cutter comprising a paper knife pivotally mounted adjacent its opposite ends on a pair of arcuate arms pivotally attached to a supporting table, means for selectively operating said paper knife blade to swing it on said arcuate arms with a slicing action, said operating means extending from the supporting table to the knife blade, whereby the blade operating apparatus is positioned beneath and not above the table, means for enabling quick sets of the paper under the knife blade, said quick set means comprising a back gauge having a plurality of tooth plates separated from each other by spacer means, said tooth plates having a hole near the rear side thereof, and securing means including a rod fitted loosely through said holes in said tooth plates and said spacers, whereby said toothed plates conform to and accommodate surface irregularities on said supporting table.

7. The cutter of claim 1 wherein said quick set means comprises means for mounting said back gauge on a feed screw positioned below said table top and means above said table top for selectively releasing said back gauge from said feed screw, whereby said back gauge may be manually slid to a selected position where said feed screw releasing means may be operated to reengage said back gauge and said feed screw.

8. A hydraulic paper cutter comprising a paper knife pivotally mounted adjacent its opposite ends on a pair of arcuate arms pivotally attached to a supporting table, means for selectively operating said paper knife blade to swing it on said arcuate arms with a slicing action, said operating means extending from the supporting table to the knife blade, whereby the blade operating apparatus is positioned beneath and not above the table, means for enabling quick sets of the paper under the knife blade, a comb-like toothed hold down clamp means, and means for giving the hold down clamp means a smooth and unbroken surface.

9. A table high paper cutter having a table with a horizontal top working surface and a sheet metal base for supporting said horizontal top working surface, said cutter comprising guillotine knife means suspended immediately over said horizontal top working surface mounted on said base, hydraulic ram means extending between said knife and a point on the table below the level of said horizontal top, whereby it is simple to reach over the knife and table to make any adjustments on said cutter, back gauge means above said top surface and releasably mounted on a feed device positioned under said horizontal top surface to slide toward or away from said knife, means associated with said feed device under said top surface and controlled from a point above said top surface for quickly and easily changing the setting of said back gauge to any position to which it may slide when said quick change means is released from said feed device, thereby reducing the time required for back gauge adjustments, and hold down clamp means positioned above said top surface and controlled by means positioned below and horizontal top surface, said back gauge and hold down clamp being comb-like toothed structures which come together with intermeshed teeth so that they do not interfere with or limit the movement of each other.

10. A table high paper cutter having a sheet metal base, said cutter comprising guillotine knife means suspended over a table mounted on said base, hydraulic ram means extending between said knife and the table, whereby it is simple to reach over the knife and table to make any adjustments on said cutter, back gauge means releasably mounted on a feed device to slide it quickly and easily to any position when released from said feed device, thereby reducing the time required for back gauge adjustments, the back gauge being constructed of loosely fitting parts to accommodate minor irregularities in the surface of the table, and hold down clamp means, said back gauge and hold down clamp being comb-like toothed structures which come together with intermeshed teeth so that they do not interfere with or limit the movement of each other.

11. The cutter of claim 10 wherein said back gauge comprises means for enabling reciprocal back gauge motion over the table toward and away from said paper knife blade, said reciprocal motion means including a back gauge mounted on a feed screw, and means for selectively releasing or engaging said back gauge with said feed screw, whereby said back gauge may be manually slid to a selected position.

* * * * *